US009581075B2

(12) United States Patent
Gonze et al.

(10) Patent No.: US 9,581,075 B2
(45) Date of Patent: Feb. 28, 2017

(54) COOLANT CONTROL SYSTEMS AND METHODS FOR WARMING ENGINE OIL AND TRANSMISSION FLUID

(71) Applicant: GM Global Technology Operations LLC, Detroit, MI (US)

(72) Inventors: Eugene V. Gonze, Pinckney, MI (US); George M. Claypole, Fenton, MI (US); Yue-Ming Chen, Canton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 441 days.

(21) Appl. No.: 13/804,620

(22) Filed: Mar. 14, 2013

(65) Prior Publication Data

US 2014/0261254 A1 Sep. 18, 2014

(51) Int. Cl.
*F01P 7/14* (2006.01)
*F01P 11/08* (2006.01)

(52) U.S. Cl.
CPC ..... *F01P 11/08* (2013.01)

(58) Field of Classification Search
CPC ..... F01P 2007/146; F01P 2060/045; F01P 7/165; F01P 3/20; F01P 7/167; F01M 5/007; F01M 5/001; F01M 5/005
USPC ..... 123/41.08, 41.1, 41.11, 41.29; 701/102
See application file for complete search history.

(56) References Cited

U.S. PATENT DOCUMENTS 4,517,929 A * 5/1985 Musick ..... F01P 3/20 123/41.1
5,598,705 A * 2/1997 Uzkan ..... 60/599
5,730,089 A * 3/1998 Morikawa ..... B60H 1/00885 123/41.14
5,960,872 A * 10/1999 Huemer ..... F01M 5/007 123/196 AB
6,006,731 A * 12/1999 Uzkan ..... F01P 7/165 123/41.29
6,178,928 B1 1/2001 Corriveau
6,314,920 B1 * 11/2001 Suzuki ..... F01P 7/048 123/41.1

(Continued)

FOREIGN PATENT DOCUMENTS

CN 101529061 A 9/2009
CN 102052137 A 5/2011

(Continued)

OTHER PUBLICATIONS

Office Action dated Aug. 14, 2014, from the German Patent Office for German Patent Application No. 10 2014 102 573.3; 5 pages.
U.S. Appl. No. 14/804,761, filed Jul. 21, 2015, Gonze et al.

*Primary Examiner* — Marguerite McMahon
*Assistant Examiner* — James Kim

(57) ABSTRACT

A coolant control system of a vehicle includes a target pressure module and a thermostat valve control module. The target pressure module determines a target pressure of coolant in a coolant path between a thermostat valve and at least one of an engine oil heat exchanger and a transmission fluid heat exchanger. The thermostat valve control module closes the thermostat valve and blocks coolant flow out of an engine when a temperature of coolant within the engine is less than a predetermined temperature. When the temperature is greater than the predetermined temperature, the thermostat valve control module controls opening of the thermostat valve to the coolant path based on the target pressure.

20 Claims, 3 Drawing Sheets

(56) References Cited

U.S. PATENT DOCUMENTS

| | | | | |
|---|---|---|---|---|
| 6,390,031 | B1 * | 5/2002 | Suzuki | F01P 7/048 123/41.1 |
| 6,843,211 | B2 * | 1/2005 | Iwasaki | B60H 1/02 123/41.31 |
| 8,104,449 | B2 | 1/2012 | Throop et al. | |
| 8,342,141 | B2 * | 1/2013 | Dahl | F01P 7/167 123/41.1 |
| 2003/0116105 | A1 * | 6/2003 | Pfeffinger | F01P 3/20 123/41.31 |
| 2006/0042567 | A1 * | 3/2006 | Figura | F01P 11/029 123/41.14 |
| 2006/0157000 | A1 * | 7/2006 | Lutze | F01P 3/20 123/41.02 |
| 2006/0288967 | A1 * | 12/2006 | Joyce et al. | 123/41.08 |
| 2009/0283364 | A1 * | 11/2009 | Throop | F01M 5/001 184/6.22 |
| 2009/0301409 | A1 * | 12/2009 | Dahl | F01P 7/167 123/41.1 |
| 2011/0048390 | A1 * | 3/2011 | Washburn | F01P 7/162 123/568.21 |
| 2014/0372008 | A1 | 12/2014 | Bockenstette et al. | |

FOREIGN PATENT DOCUMENTS

| | | | |
|---|---|---|---|
| DE | 102009017748 | A1 | 10/2010 |
| DE | 102011120206 | A1 | 6/2013 |
| EP | 0965737 | A2 | 12/1999 |
| EP | 2243937 | A1 | 10/2010 |

* cited by examiner

COOLANT CONTROL SYSTEMS AND METHODS FOR WARMING ENGINE OIL AND TRANSMISSION FLUID

FIELD

The present disclosure relates to vehicles with internal combustion engines and more particularly to systems and methods for controlling engine coolant flow.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An internal combustion engine combusts air and fuel within cylinders to generate drive torque. Combustion of air and fuel generates heat. Excessive heating of the engine and/or engine components may shorten the lifetime of the engine and/or the engine components.

Typically, vehicles that include an internal combustion engine also include a radiator that is connected to coolant channels within the engine. Engine coolant circulates through the coolant channels and the radiator. The engine coolant absorbs heat from the engine and carries the heat to the radiator. The radiator transfers heat from the engine coolant to air passing the radiator. The cooled engine coolant exiting the radiator is circulated back to the engine.

SUMMARY

In a feature, a coolant control system of a vehicle includes a target pressure module and a thermostat valve control module. The target pressure module determines a target pressure of coolant in a coolant path between a thermostat valve and at least one of an engine oil heat exchanger and a transmission fluid heat exchanger. The thermostat valve control module closes the thermostat valve and blocks coolant flow out of an engine when a temperature of coolant within the engine is less than a predetermined temperature. When the temperature is greater than the predetermined temperature, the thermostat valve control module controls opening of the thermostat valve to the coolant path based on the target pressure.

In further features, the coolant control system further includes a coolant valve control module that closes a coolant valve and blocks coolant flow into the engine when the temperature is less than the predetermined temperature and that opens the coolant valve when the temperature is greater than the predetermined temperature.

In still further features, the coolant control system further includes a pump control module that disables a coolant pump when the temperature is less than the predetermined temperature and that, when the temperature is greater than the predetermined temperature, controls a speed of the coolant pump based on the target pressure.

In yet further features, the pump control module controls the speed of the coolant pump further based on a coolant flowrate through the engine, the engine oil heat exchanger, and the transmission fluid heat exchanger.

In further features, the thermostat valve control module controls the opening of the thermostat valve to the coolant path further based on a coolant flowrate through the engine.

In still further features, the thermostat valve control module further closes the thermostat valve and blocks coolant flow to a second coolant path between the thermostat valve and a radiator when at least one of an engine oil temperature is less than a first predetermined temperature and a transmission fluid temperature is less than a second predetermined temperature.

In yet further features, the thermostat valve control module further opens the thermostat valve and allows coolant flow to the second coolant path when the engine oil temperature is greater than the first predetermined temperature and the transmission fluid temperature is greater than the second predetermined temperature.

In further features, the coolant control system further includes: a heat rejection module that determines a heat rejection rate of the engine to coolant within the engine; and a maximum coolant flow module that determines a maximum coolant flowrate through the engine oil and transmission fluid heat exchangers based on the heat rejection rate. The target pressure module determines the target pressure based on the maximum coolant flowrate.

In yet further features, the heat rejection module determines the heat rejection rate based on an engine speed, an engine load, and at least one of a first temperature of coolant at an inlet of the engine and a second temperature of coolant at an outlet of the engine.

In still further features, the maximum coolant flow module determines the maximum coolant flowrate further based on a predetermined coolant temperature increase between an inlet of the engine and an outlet of the engine.

In a feature, a coolant control method for a vehicle includes: determining a target pressure of coolant in a coolant path between a thermostat valve and at least one of an engine oil heat exchanger and a transmission fluid heat exchanger; and closing the thermostat valve and blocking coolant flow out of an engine when a temperature of coolant within the engine is less than a predetermined temperature. The coolant control method further includes, when the temperature is greater than the predetermined temperature, controlling opening of the thermostat valve to the coolant path based on the target pressure.

In further features the coolant control method further includes: closing a coolant valve and blocking coolant flow into the engine when the temperature is less than the predetermined temperature; and opening the coolant valve when the temperature is greater than the predetermined temperature.

In still further features the coolant control method further includes: disabling a coolant pump when the temperature is less than the predetermined temperature; and, when the temperature is greater than the predetermined temperature, controlling a speed of the coolant pump based on the target pressure.

In yet further features the coolant control method further includes controlling the speed of the coolant pump further based on a coolant flowrate through the engine, the engine oil heat exchanger, and the transmission fluid heat exchanger.

In further features the coolant control method further includes controlling the opening of the thermostat valve to the coolant path further based on a coolant flowrate through the engine.

In still further features the coolant control method further includes closing the thermostat valve and blocking coolant flow to a second coolant path between the thermostat valve and a radiator when at least one of: an engine oil temperature is less than a first predetermined temperature; and a transmission fluid temperature is less than a second predetermined temperature.

In yet further features the coolant control method further includes opening the thermostat valve and allowing coolant flow to the second coolant path when the engine oil temperature is greater than the first predetermined temperature and the transmission fluid temperature is greater than the second predetermined temperature.

In further features the coolant control method further includes: determining a heat rejection rate of the engine to coolant within the engine; determining a maximum coolant flowrate through the engine oil and transmission fluid heat exchangers based on the heat rejection rate; and determining the target pressure based on the maximum coolant flowrate.

In yet further features the coolant control method further includes determining the heat rejection rate based on an engine speed, an engine load, and at least one of a first temperature of coolant at an inlet of the engine and a second temperature of coolant at an outlet of the engine.

In still further features the coolant control method further includes determining the maximum coolant flowrate further based on a predetermined coolant temperature increase between an inlet of the engine and an outlet of the engine.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An engine combusts air and fuel to generate drive torque. Combustion also generates heat. Traditionally, a coolant system is used to absorb heat from the engine, engine oil, transmission fluid, and other components and to transfer heat to air. Under some circumstances, however, the engine oil and the transmission fluid may be cold, such as when a vehicle is started. Viscosity of the engine oil and viscosity of the transmission fluid are inversely related to temperature. Torque losses/loads associated with the engine oil and the transmission fluid increase as viscosity increases.

A coolant controller according to the present disclosure controls coolant flow through the engine and to heat exchangers of the engine oil and transmission fluid to warm the engine oil and transmission fluids to predetermined temperatures quickly. Warming the engine oil and the transmission fluid quickly minimizes the torque losses/loads associated with the engine oil and the transmission fluid. Warming the engine oil and the transmission fluid quickly may therefore reduce fuel consumption and/or provide one or more other benefits.

Figure 1:
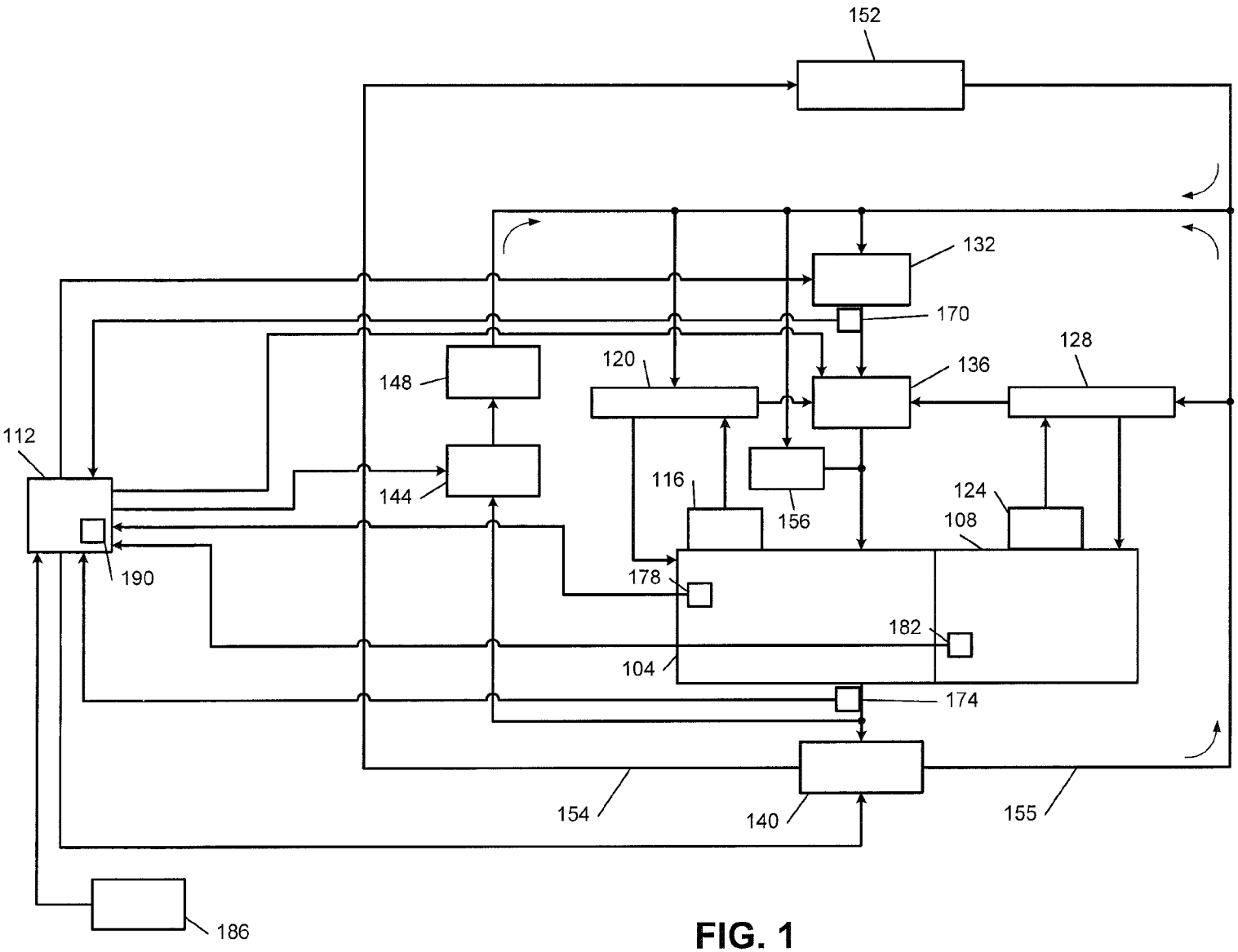
FIG. 1 is a functional block diagram of an example vehicle system according to the present disclosure.

Referring now to FIG. 1, a functional block diagram of an example vehicle system is presented. An engine 104 combusts a mixture of air and fuel within cylinders to generate drive torque. The engine 104 outputs torque to a transmission 108. The transmission 108 transfers torque to one or more wheels of a vehicle via a driveline (not shown). An engine control module (ECM) 112 may control one or more engine actuators to regulate the torque output of the engine 104.

An engine oil pump 116 circulates engine oil through the engine 104 and a first heat exchanger 120. The first heat exchanger 120 may be referred to as an (engine) oil cooler. When the engine oil is cold, the first heat exchanger 120 may transfer heat to engine oil within the first heat exchanger 120 from coolant flowing through the first heat exchanger 120. The first heat exchanger 120 may transfer heat from the engine oil to coolant flowing through the first heat exchanger 120 and/or to air passing the first heat exchanger 120 when the engine oil is warm.

Viscosity of the engine oil is inversely related to temperature of the engine oil. That is, viscosity of the engine oil decreases as the temperature increases and vice versa. Frictional losses (e.g., torque losses) of the engine 104 associated with the engine oil may decrease as viscosity of the engine oil decreases and vice versa.

A transmission fluid pump 124 circulates transmission fluid through the transmission 108 and a second heat exchanger 128. The second heat exchanger 128 may be referred to as a transmission cooler. When the transmission fluid is cold, the second heat exchanger 128 may transfer heat to transmission fluid within the second heat exchanger 128 from coolant flowing through the second heat exchanger 128. The second heat exchanger 128 may transfer heat from the transmission fluid to coolant flowing through the second heat exchanger 128 and/or to air passing the second heat exchanger 128 when the transmission fluid is warm.

Viscosity of the transmission fluid is inversely related to temperature of the transmission fluid. That is, viscosity of the transmission fluid decreases as the temperature increases and vice versa. Losses (e.g., torque losses) associated with the transmission fluid may decrease as viscosity of the transmission fluid decreases and vice versa.

The engine 104 includes a plurality of channels through which engine coolant ("coolant") can flow. For example, the engine 104 may include one or more channels through a head portion of the engine 104, one or more channels through a block portion of the engine 104, and/or one or more channels through an internal exhaust manifold (IEM) of the engine 104. The engine 104 may additionally or alternatively include one or more other suitable coolant channels.

An electric coolant pump 132 pumps coolant into the engine 104 through a coolant valve 136. The coolant valve 136 can be opened to allow coolant to flow from the coolant pump 132 to the engine 104. When the coolant valve 136 is open, coolant output from the first heat exchanger 120 and coolant output from the second heat exchanger 128 may also flow to the engine 104. The coolant valve 136 may be closed, for example, to retain coolant within the engine 104.

The engine 104 outputs coolant to a thermostat valve 140 and a heater valve 144. The heater valve 144 may be opened to enable coolant flow through a third heat exchanger 148, which may be referred to as a heater core. Air may be circulated past the third heat exchanger 148, for example, to warm a passenger cabin of the vehicle.

The thermostat valve 140 can be referred to as an active thermostat valve. Unlike passive thermostat valves which automatically open and close when a coolant temperature is greater than and less than a predetermined temperature, respectively, active thermostat valves are electrically actuated.

The thermostat valve 140 controls coolant flow out of the engine 104, coolant flow to a fourth heat exchanger 152, and coolant flow to other components, such as the coolant pump 132, and the first and second heat exchangers 120 and 124. Coolant flows from the thermostat valve 140 to the fourth heat exchanger 152 via a first coolant path 154. Coolant flows from the thermostat valve 140 to the other components via a second coolant path 155.

For example, the thermostat valve 140 can be closed to maintain coolant within the engine 104. A first valve of the thermostat valve 140 can be actuated to control coolant flow to the fourth heat exchanger 152. A second valve of the thermostat valve 140 can be actuated to control coolant flow to the other components. The fourth heat exchanger 152 may be referred to as a radiator.

Various types of engines may include one or more turbochargers, such as turbocharger 156. Coolant may be circulated through a portion of the turbocharger 156, for example, to cool the turbocharger 156.

A coolant input temperature sensor 170 measures a temperature of coolant input to the engine 104. A coolant output temperature sensor 174 measures a temperature of coolant output from the engine 104. An oil temperature sensor 178 measures a temperature of the engine oil, such as within the engine 104. A transmission fluid temperature sensor 182 measures a temperature of the transmission fluid, such as within the transmission 108. One or more other sensors 186 may be implemented, such as one or more engine (e.g., block and/or head) temperature sensors, an IEM temperature sensor, a radiator output temperature sensor, a crankshaft position sensor, a mass air flowrate (MAF) sensor, a manifold absolute pressure (MAP) sensor, and/or one or more other suitable vehicle sensors.

A coolant control module 190 (see also FIG. 2) may control the coolant valve 136, the heater valve 144, the thermostat valve 140, and the coolant pump 132 as discussed further below. While the coolant control module 190 is shown as being implemented within the ECM 112, the coolant control module 190 or one or more portions of the coolant control module 190 may be implemented in another module or independently.

Figure 2:
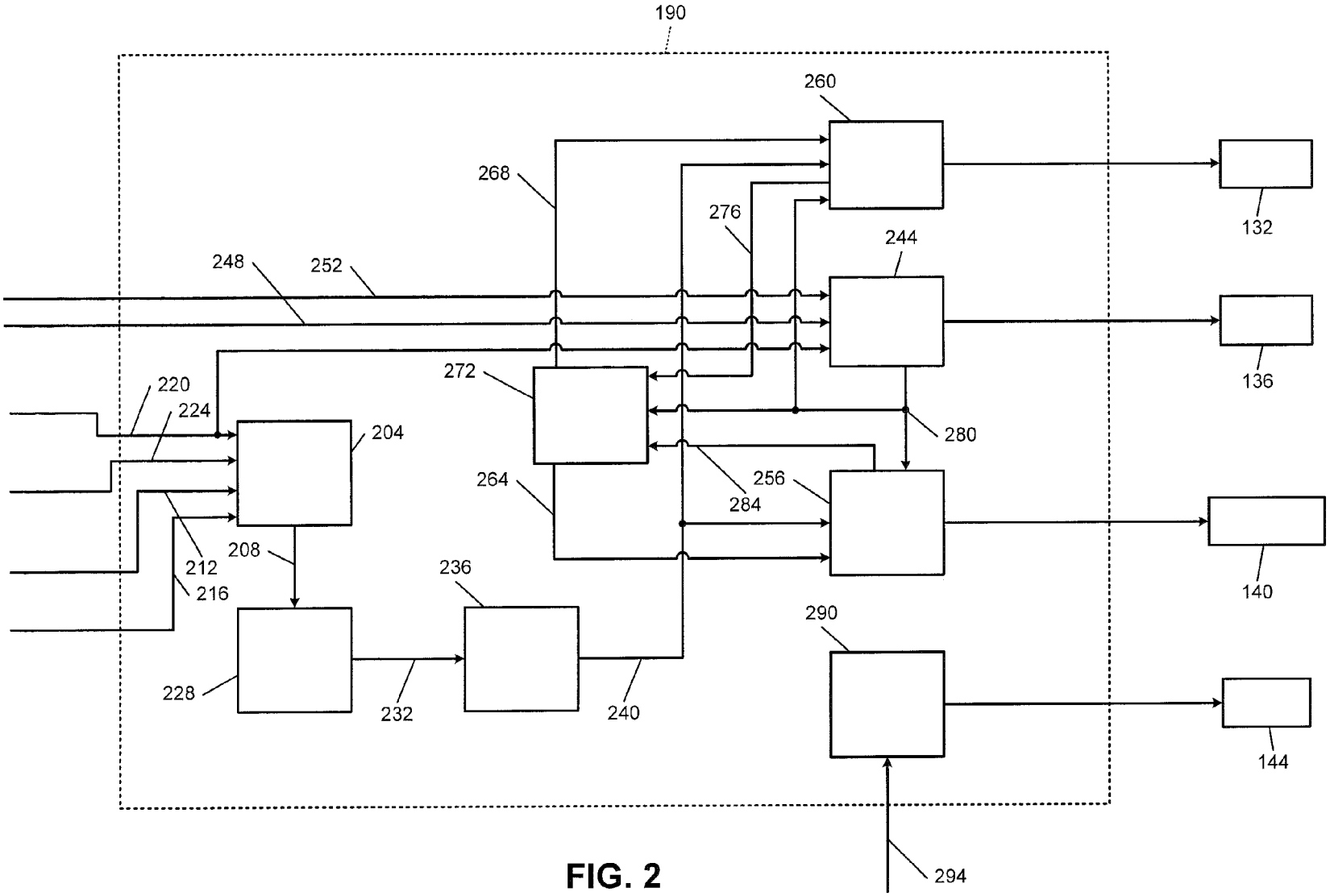
FIG. 2 is a functional block diagram of an example coolant control module according to the present disclosure.

Referring now to FIG. 2, a functional block diagram of an example implementation of the coolant control module 190 is presented. A heat rejection module 204 determines an amount of heat rejected by the engine 104 to coolant within the engine 104, such as a heat rejection rate 208 of the engine 104.

The heat rejection module 204 determines the heat rejection rate 208 of the engine 104 based on an engine speed 212, an engine load 216, and at least one of a coolant output temperature 220 and a coolant input temperature 224. The heat rejection module 204 may determine the heat rejection rate 208 of the engine 104 using one of a mapping and a function that relates the engine speed 212, the engine load 216, and at least one of the coolant output temperature 220 and the coolant input temperature 224 to the heat rejection rate 208 of the engine 104.

While the heat rejection rate 208 of the engine 104 is discussed, heat absorption rate of coolant within the engine 104 may be used in various implementations. Heat absorption rate of coolant within the engine 104 may be determined based on the engine speed 212, the engine load 216, and at least one of the coolant output temperature 220 and the coolant input temperature 224.

The coolant output temperature 220 may be measured using the coolant output temperature sensor 174. The coolant input temperature 224 may be measured using the coolant input temperature sensor 170. The engine speed 212 may be determined based on crankshaft positions measured using a crankshaft position sensor. The engine load 216 may be determined, for example, based on measurements of a MAF sensor and/or measurements of a MAP sensor. The engine load 216 may correspond to a ratio of a current amount (e.g., mass) of air per cylinder (APC) to a maximum APC of the engine 104.

A maximum coolant flow module 228 determines a maximum coolant flowrate 232 through the first and second heat exchangers 120 and 124. The maximum coolant flow module 228 determines the maximum coolant flowrate 232 based on the heat rejection rate 208 of the engine 104, a target coolant temperature increase across the engine 104, and a heat transfer capacity of the coolant. The maximum coolant flow module 228 may determine the maximum coolant flowrate 232, for example, using a function or a mapping that relates the heat rejection rate 208 of the engine 104, the target coolant temperature increase across the engine 104, and the heat transfer capacity of the coolant to the maximum coolant flowrate 232.

For example only, the maximum coolant flow module 228 may determine the maximum coolant flowrate 232 using the equation:

$$\dot{m} = \frac{c * \Delta T}{\dot{Q}},$$

where $\dot{m}$ is the maximum coolant flowrate 232, C is the heat transfer capacity of the coolant, and ΔT is the target coolant temperature increase across the engine 104. The heat transfer capacity of the coolant and the target coolant temperature increase may be predetermined values. For example only, the target coolant temperature increase across the engine 104 may be approximately 10 degrees Celsius (° C.) or another suitable temperature.

A target pressure module 236 determines a target pressure 240 in the second coolant path 155. The target pressure module 236 determines the target pressure 240 based on the maximum coolant flowrate 232 and a flow resistance of the first and second heat exchangers 120 and 128. The target pressure module 236 may determine the target pressure 240, for example, using a function or a mapping that relates the maximum coolant flowrate 232 and the flow resistance to the target pressure 240. The flow resistance may be a predetermined value and may correspond to a coolant flowrate restriction associated with the first and second heat exchangers 120 and 128.

A coolant valve control module 244 controls the coolant valve 136. The coolant valve control module 244 may control the coolant valve 136, for example, based on the coolant output temperature 220, an engine oil temperature 248, and/or a transmission fluid temperature 252.

For example, the coolant valve control module 244 may maintain the coolant valve 136 at a predetermined fully closed position when the coolant output temperature 220 is less than a first predetermined temperature, the engine oil temperature 248 is less than a second predetermined temperature, and/or the transmission fluid temperature 252 is less than a third predetermined temperature. The coolant valve control module 244 may open the coolant valve 136 to a predetermined open position when the coolant output temperature 220 is greater than the first predetermined temperature, the engine oil temperature 248 is greater than the second predetermined temperature, and the transmission fluid temperature 252 is greater than the third predetermined temperature. The engine oil temperature 248 may be measured using the oil temperature sensor 178. The transmission fluid temperature 252 may be measured using the transmission fluid temperature sensor 182.

A thermostat valve control module 256 controls the thermostat valve 140, and a pump control module 260 controls the coolant pump 132. When the coolant valve 136 is open, the thermostat valve control module 256 determines a target position of the thermostat valve 140 for controlling coolant flow through the thermostat valve 140 to the second coolant path 155.

The thermostat valve control module 256 determines the target position based on the target pressure 240 and an engine coolant flowrate 264. For example, the thermostat valve control module 256 may determine the target position using a function or a mapping that relates the target pressure 240 and the engine coolant flowrate 264 to the target position. The engine coolant flowrate 264 may correspond to a current flowrate of coolant through the engine 104. The thermostat valve control module 256 controls the thermostat valve 140 based on the target position.

When the coolant valve 136 is open, the pump control module 260 determines a target speed for the coolant pump 132 based on the target pressure 240 and a total coolant flowrate 268. For example, the pump control module 260 may determine the target speed using a function or a mapping that relates the target pressure 240 and the total coolant flowrate 268 to the target speed. The total coolant flowrate 268 may correspond to a current flowrate of coolant through both the engine 104 and the first and second heat exchangers 120 and 128. The pump control module 260 controls the coolant pump 132 based on the target speed.

A coolant flow module 272 may determine the engine coolant flowrate 264 and the total coolant flowrate 268. The coolant flow module 272 may determine the engine coolant flowrate 264 and the total coolant flowrate 268, for example, based on a speed 276 of the coolant pump 132, a position 280 of the coolant valve 136, and a position 284 of the thermostat valve 140. For example, the coolant flow module 272 may determine the engine coolant flowrate 264 and the total coolant flowrate 268 using functions or mappings that relate the speed 276 of the coolant pump 132, the position 280 of the coolant valve 136, and the position 284 of the thermostat valve 140 to the engine coolant flowrate 264 and the total coolant flowrate 268. Control of the coolant valve 136, the thermostat valve 140, and the coolant pump 132 will be discussed further in conjunction with the example of FIG. 3.

A heater valve control module 290 may control the heater valve 144 based on user input 294 and/or one or more other parameters. When the engine oil and the transmission fluid are greater than predetermined temperatures, the heater valve control module 290 may open the heater valve 144 in response to user input requesting heating of a passenger cabin of the vehicle. The heater valve control module 290 may maintain the heater valve 144 closed when user input requesting heating of the passenger cabin has been received, for example, until the engine oil and the transmission fluid are greater than predetermined temperatures.

Figure 3:
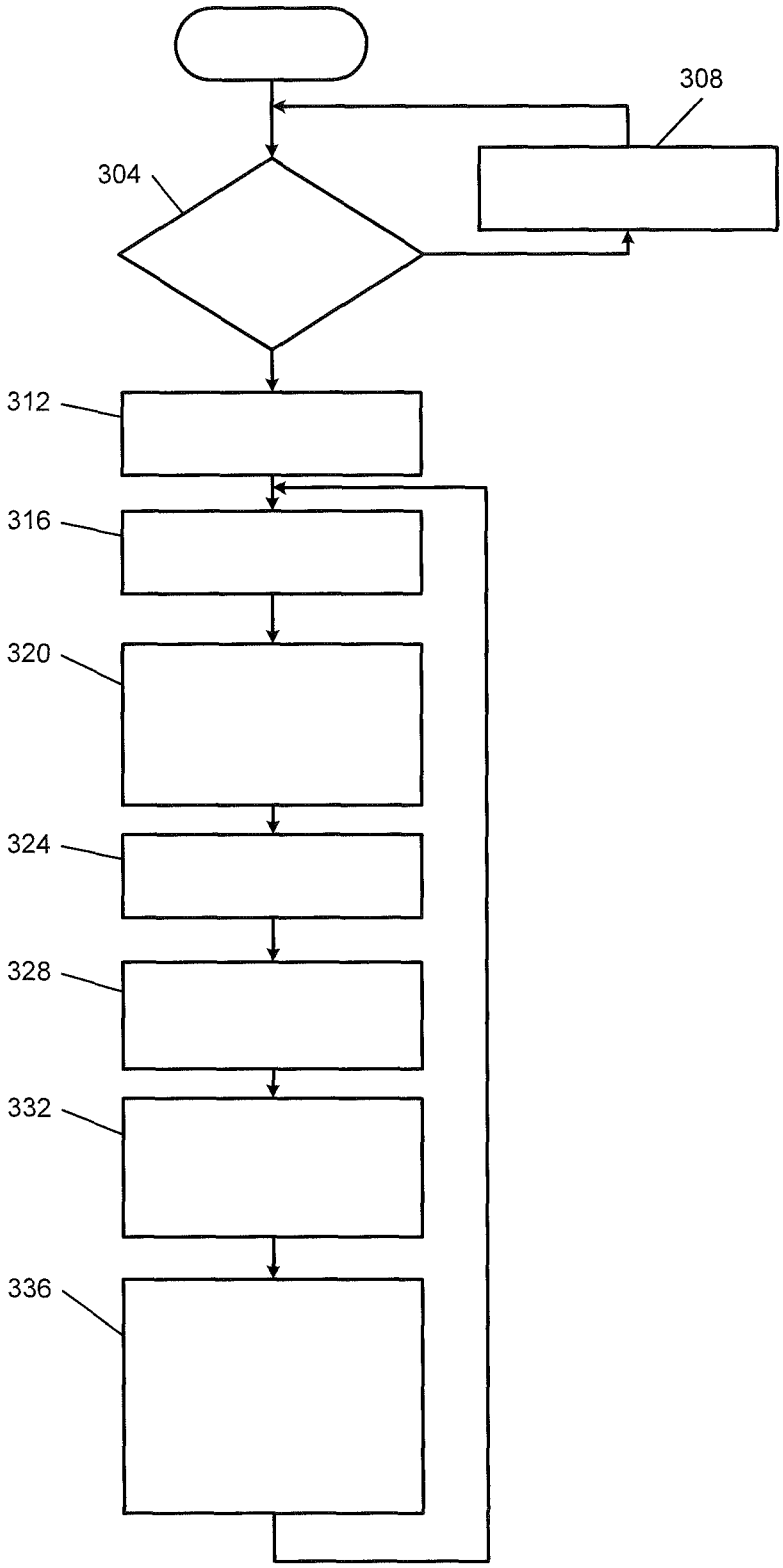
FIG. 3 is a flowchart depicting an example method of controlling a thermostat valve, a coolant valve, and a coolant pump according to the present disclosure.

Referring now to FIG. 3, a flowchart depicting an example method of controlling the coolant valve 136, the thermostat valve 140, and the coolant pump 132 is presented. The coolant valve 136, the thermostat valve 140, and the heater valve 144 are closed and the coolant pump 132 is off when control begins. Control may begin, for example, at startup of the engine 104, when the engine oil and the transmission fluid may be cold. As described above, viscosity of the engine oil and the transmission fluid increases as temperature decreases, and vice versa.

At 304, the coolant valve control module 244 may determine whether the coolant trapped within the engine 104 is warming. If 304 is false, at 308, the pump control module 260 may maintain the coolant pump 132 off and the coolant valve control module 244, the thermostat valve control module 256, and the heater valve control module 290 may maintain the coolant valve 136, the thermostat valve 140, and the heater valve 144 closed, respectively. Retaining the coolant within the engine 104 allows the coolant within the engine 104 to warm and may warm the engine oil. If relatively cooler coolant was instead pumped into the engine 104, the relatively cooler coolant may cool the engine oil and the transmission fluid. Control may return to 304 after 308. If 304 is true, control may continue with 312.

The coolant valve control module 244 may determine that the coolant trapped within the engine 104 is warming, for example, when the coolant output temperature 220 is less than the first predetermined temperature, the engine oil temperature 248 is less than the second predetermined temperature, and/or the transmission fluid temperature 252 is less than the third predetermined temperature. For example only, the first predetermined temperature may be approximately 90° C. or another suitable value. The second predetermined temperature may be less than the first predetermined temperature, and the third predetermined temperature may be less than the second predetermined temperature.

At 312, the coolant valve control module 244 opens the coolant valve 136. Coolant can flow into the engine 104 when the coolant valve 136 is open. At 316, the heat rejection module 204 determines the heat rejection rate 208 of the engine 104. The heat rejection module 204 determines the heat rejection rate 208 based on the engine speed 212, the engine load 216, and at least one of the coolant output temperature 220 and the coolant input temperature 224.

The maximum coolant flow module 228 determines the maximum coolant flowrate 232 at 320 based on the heat rejection rate 208 of the engine 104, the target coolant temperature increase across the engine 104, and the heat transfer capacity of the coolant. At 324, the target pressure module 236 determines the target pressure 240 based on the maximum coolant flowrate 232 and the flow resistance of the first and second heat exchangers 120 and 128.

At 328, the coolant flow module 272 may determine the engine coolant flowrate 264 and the total coolant flowrate 268. The coolant flow module 272 may determine the engine coolant flowrate 264 and the total coolant flowrate 268, for example, based on the speed 276 of the coolant pump 132, the position 280 of the coolant valve 136, and the position 284 of the thermostat valve 140.

When the coolant valve 136 is open, the thermostat valve control module 256 determines the target position for the thermostat valve 140 for controlling coolant flow through the thermostat valve 140 to the second coolant path 155 at 332. The thermostat valve control module 256 determines the target position based on the target pressure 240 and the engine coolant flowrate 264. The pump control module 260 may also determine the target speed for the coolant pump 132 at 332. The pump control module 260 may determine the target speed based on the target pressure 240 and the total coolant flowrate 268.

At 336, the thermostat valve control module 256 controls the thermostat valve 140 to control coolant flow to the second coolant path 155 based on the target position. The pump control module 260 may also control the coolant pump 132 based on the target speed at 336. Control may return to 316.

Once the coolant output temperature 220 is greater than a predetermined temperature (e.g., for a predetermined period), the thermostat valve control module 256 may begin to open the thermostat valve 140 to allow coolant flow through the thermostat valve 140 to the first coolant path 154. Alternatively, the thermostat valve control module 256 may begin to open the thermostat valve 140 to allow coolant flow to the first current path 154 when the engine oil temperature 248 and the transmission fluid temperature 252 are greater than predetermined temperatures.

The heater valve control module 290 may begin to open the heater valve 144 to allow coolant flow to the third heat exchanger 148 once the coolant output temperature 220 is greater than a predetermined temperature (e.g., for a predetermined period). Alternatively, the heater valve control module 290 may begin to open the heater valve 144 to allow coolant flow to the third heat exchanger 148 when the engine oil temperature 248 and the transmission fluid temperature 252 are greater than predetermined temperatures.

Controlling the coolant valve 136, the thermostat valve 140, the heater valve 144, and the coolant pump 132 as described above may warm the engine oil and the transmission fluid faster than if the valves were opened while the coolant is cold. Warming the engine oil and the transmission fluid faster reduces friction experienced by the engine 104 and the transmission 108 and may reduce fuel consumption and provide one or more other benefits.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A coolant control system of a vehicle, comprising:

a target pressure module that determines a target pressure of coolant in a first coolant path from a thermostat valve to at least one of an engine oil heat exchanger and a transmission fluid heat exchanger; and a thermostat valve control module that:

when a temperature of coolant within the engine is less than a predetermined temperature, closes the thermostat valve, thereby blocking coolant flow out of an engine, blocking coolant flow out of the thermostat valve to the first coolant path, and blocking coolant flow to a second coolant path from the thermostat valve to a radiator;

when the temperature is greater than the predetermined temperature:

at a first time, actuates the thermostat valve to open the thermostat valve to the first coolant path based on the target pressure and to block coolant flow to the second coolant path from the thermostat valve to the radiator; and at a second time, after the first time, opens the thermostat valve to the second coolant path from the thermostat valve to the radiator.

2. The coolant control system of claim 1 further comprising a coolant valve control module that closes a coolant valve and blocks coolant flow into the engine when the temperature is less than the predetermined temperature and that opens the coolant valve when the temperature is greater than the predetermined temperature.

3. The coolant control system of claim 1 further comprising a pump control module that disables a coolant pump when the temperature is less than the predetermined temperature and that, when the temperature is greater than the predetermined temperature, controls a speed of the coolant pump based on the target pressure.

4. The coolant control system of claim 3 wherein the pump control module controls the speed of the coolant pump further based on a coolant flowrate through the engine, the engine oil heat exchanger, and the transmission fluid heat exchanger.

5. The coolant control system of claim 1 wherein the thermostat valve control module controls the opening of the thermostat valve to the first coolant path further based on a coolant flowrate through the engine.

6. The coolant control system of claim 1 wherein the thermostat valve control module opens the thermostat valve to the first coolant path based on the target pressure and blocks coolant flow to the second coolant path from the thermostat valve to the radiator when at least one of an engine oil temperature is less than a first predetermined temperature and a transmission fluid temperature is less than a second predetermined temperature.

7. The coolant control system of claim 6 wherein the thermostat valve control module opens the thermostat valve to the second coolant path from the thermostat valve to the radiator when the engine oil temperature is greater than the first predetermined temperature and the transmission fluid temperature is greater than the second predetermined temperature.

8. The coolant control system of claim 1 further comprising:

a heat rejection module that determines a heat rejection rate of the engine to coolant within the engine; and a maximum coolant flow module that determines a maximum coolant flowrate through the engine oil and transmission fluid heat exchangers based on the heat rejection rate, wherein the target pressure module determines the target pressure based on the maximum coolant flowrate.

9. The coolant control system of claim 8 wherein the heat rejection module determines the heat rejection rate based on an engine speed, an engine load, and at least one of a first temperature of coolant at an inlet of the engine and a second temperature of coolant at an outlet of the engine.

10. The coolant control system of claim 8 wherein the maximum coolant flow module determines the maximum coolant flowrate further based on a predetermined coolant temperature increase between an inlet of the engine and an outlet of the engine.

11. A coolant control method for a vehicle, comprising:

determining a target pressure of coolant in first coolant path from a thermostat valve to at least one of an engine oil heat exchanger and a transmission fluid heat exchanger;

when a temperature of coolant within the engine is less than a predetermined temperature, closing the thermostat valve, thereby blocking coolant flow out of an engine, blocking coolant flow out of the thermostat valve to the first coolant path, and blocking coolant flow to a second coolant path from the thermostat valve to a radiator; and, when the temperature is greater than the predetermined temperature:

at a first time, actuating the thermostat valve to open the thermostat valve to the first coolant path based on the target pressure and to continue blocking coolant flow to the second coolant path from the thermostat valve to the radiator; and at a second time, after the first time, opening the thermostat valve to the second coolant path from the thermostat valve to the radiator.

12. The coolant control method of claim 11 further comprising:

closing a coolant valve and blocking coolant flow into the engine when the temperature is less than the predetermined temperature; and opening the coolant valve when the temperature is greater than the predetermined temperature.

13. The coolant control method of claim 11 further comprising:

disabling a coolant pump when the temperature is less than the predetermined temperature; and, when the temperature is greater than the predetermined temperature, controlling a speed of the coolant pump based on the target pressure.

14. The coolant control method of claim 13 further comprising controlling the speed of the coolant pump further based on a coolant flowrate through the engine, the engine oil heat exchanger, and the transmission fluid heat exchanger.

15. The coolant control method of claim 11 further comprising controlling the opening of the thermostat valve to the first coolant path further based on a coolant flowrate through the engine.

16. The coolant control method of claim 11 further comprising actuating the thermostat valve to open the thermostat valve to the first coolant path based on the target pressure and to block coolant flow to the second coolant path from the thermostat valve to the radiator when at least one of:

an engine oil temperature is less than a first predetermined temperature; and a transmission fluid temperature is less than a second predetermined temperature.

17. The coolant control method of claim 16 further comprising opening the thermostat valve to the second coolant path when the engine oil temperature is greater than the first predetermined temperature and the transmission fluid temperature is greater than the second predetermined temperature.

18. The coolant control method of claim 11 further comprising:

determining a heat rejection rate of the engine to coolant within the engine;

determining a maximum coolant flowrate through the engine oil and transmission fluid heat exchangers based on the heat rejection rate; and determining the target pressure based on the maximum coolant flowrate.

19. The coolant control method of claim 18 further comprising determining the heat rejection rate based on an engine speed, an engine load, and at least one of a first temperature of coolant at an inlet of the engine and a second temperature of coolant at an outlet of the engine.

20. The coolant control method of claim 18 further comprising determining the maximum coolant flowrate further based on a predetermined coolant temperature increase between an inlet of the engine and an outlet of the engine.

* * * * *